US011108191B2

(12) United States Patent
Iida

(10) Patent No.: US 11,108,191 B2
(45) Date of Patent: Aug. 31, 2021

(54) CONNECTOR WITH COVER TO SUPPRESS DEFORMATION OF SEALING MEMBERS AND MAINTAIN WATERPROOFING

(71) Applicant: Sumitomo Wiring Systems, Ltd., Mie (JP)

(72) Inventor: Koji Iida, Mie (JP)

(73) Assignee: Sumitomo Wiring Systems, Ltd.

( * ) Notice: Subject to any disclaimer, the term of this patent is extended or adjusted under 35 U.S.C. 154(b) by 0 days.

(21) Appl. No.: 16/816,573

(22) Filed: Mar. 12, 2020

(65) Prior Publication Data

US 2020/0295505 A1 Sep. 17, 2020

(30) Foreign Application Priority Data

Mar. 14, 2019 (JP) ..... JP2019-046831

(51) Int. Cl.

| | |
|---|---|
| ***H01R 13/58*** | (2006.01) |
| ***H01R 13/506*** | (2006.01) |
| ***H01R 13/516*** | (2006.01) |
| ***H01R 13/52*** | (2006.01) |
| ***H01R 13/42*** | (2006.01) |
| ***H01R 13/629*** | (2006.01) |
| ***H01R 4/48*** | (2006.01) |

(52) U.S. Cl.

CPC ..... *H01R 13/58* (2013.01); *H01R 4/4809* (2013.01); *H01R 13/42* (2013.01); *H01R 13/506* (2013.01); *H01R 13/516* (2013.01); *H01R 13/5205* (2013.01); *H01R 13/629* (2013.01)

(58) Field of Classification Search

CPC ..... H01R 13/58; H01R 13/42; H01R 13/516; H01R 13/5205; H01R 13/629; H01R 13/5825; H01R 4/4809

USPC ..... 439/460

See application file for complete search history.

(56) References Cited

U.S. PATENT DOCUMENTS 5,098,315 A * 3/1992 Scowen ..... H01R 13/5221 439/587
5,551,892 A * 9/1996 Endo ..... H01R 13/443 439/587
5,573,429 A * 11/1996 Miyazaki ..... H01R 13/5205 439/587

(Continued)

FOREIGN PATENT DOCUMENTS

JP 2016-081655 5/2016

*Primary Examiner* — Peter G Leigh

(74) *Attorney, Agent, or Firm* — Gerald E. Hespos; Michael J. Porco; Matthew T. Hespos

(57) ABSTRACT

A connector includes wires (10), a connector housing (30) to hold ends of the wires (10), sealing members mounted on the wires (10) to seal clearances between the connector housing (30) and the wires (10), and a cover (40) assembled with the connector housing (30) to cover the wires (10). The connector housing (30) has a wire pull-out surface (34F1) and cavities (35) open in the wire pull-out surface (34F1) to accommodate ends of the wires (10) and the sealing members inside. The sealing member has a wire draw-out surface (20F) and includes a wire insertion hole (21) open in the wire draw-out surface (20F). The wire (10) is inserted into the wire insertion hole (21). The cover (40) includes a cover body (41) to cover the wires (10) and guides (71) extend from the cover body (41) for contacting the wire draw-out surfaces (20F) and guiding the wires (10).

8 Claims, 14 Drawing Sheets

(56) References Cited

U.S. PATENT DOCUMENTS

| | | | | |
|---|---|---|---|---|
| 6,527,586 | B2 * | 3/2003 | Okamura | H01R 13/5208 439/587 |
| 7,033,216 | B2 * | 4/2006 | Ito | H01R 13/5208 439/275 |
| 7,077,676 | B2 * | 7/2006 | Matsumoto | H01R 13/5205 439/271 |
| 7,201,595 | B1 * | 4/2007 | Morello | H01R 13/5208 439/271 |
| 7,448,908 | B2 * | 11/2008 | Iwahori | H01R 13/5219 439/587 |
| 7,597,580 | B1 * | 10/2009 | Advey | H01R 13/502 439/272 |
| 9,039,463 | B2 * | 5/2015 | Yamashita | H01R 13/187 439/852 |
| 9,929,495 | B2 * | 3/2018 | Iida | H01R 13/5219 |
| 9,960,531 | B2 * | 5/2018 | Poncini | H01R 13/502 |
| 2007/0197069 | A1 * | 8/2007 | Iwahori | H01R 13/5219 439/157 |

* cited by examiner

CONNECTOR WITH COVER TO SUPPRESS DEFORMATION OF SEALING MEMBERS AND MAINTAIN WATERPROOFING

BACKGROUND

Field of the Invention

This specification relates to a connector with cover.

Related Art

A conventional structure for sealing a clearance between end parts of a wire and a connector housing uses a rubber plug as a sealing member. A cover for covering wires drawn out from a connector housing may be mounted on a connector of this type. The wire cover guides and draws out the wires pulled out rearward from the connector housing while protecting the wires (see Japanese Unexamined Patent Publication No. 2016-81655).

There is a need for a connector to suppress deformation of sealing members and to ensure waterproofing when wires need to be bent near the rear end of the connector housing due to an insufficient wiring space or when an external force is applied to pull the wires.

SUMMARY

A connector with cover disclosed by this specification includes: a wire, a connector housing configured to hold an end of the wire, a sealing member mounted on the wire and configured to seal a clearance between the connector housing and the wire, and a cover assembled with the connector housing and configured to cover the wire. The connector housing has a wire pull-out surface, and a cavity is open in the wire pull-out surface. The cavity is configured to accommodate the end of the wire and the sealing member inside. The sealing member has a wire draw-out surface and includes a wire insertion hole that is open in the wire draw-out surface. The wire is inserted into the wire insertion hole. The cover includes a cover body that is configured to cover the wire, and a guide that extends from the cover body. The guide is configured to contact the wire draw-out surface and guide the wire.

According to the above configuration, the guide is in contact with the wire draw-out surface and holds the sealing member at a proper insertion position in the cavity. An external force applied to the wire may pull the wire in a direction separating from the cavity. However, the guide presses the sealing member and holds the sealing member at the proper position. In this way, a waterproof function is ensured.

The guide may include two holding walls aligned perpendicular to the wire pull-out surface and configured to sandwich and hold the wire. The holding walls hold the wire perpendicular to the wire pull-out surface at a position adjacent to the wire pull-out surface. A conventional connector has a cover with no holding wall, and a wire drawn out from such a connector housing may be bent to extend obliquely to a wire pull-out surface. Hence, there is a concern that the conventional sealing member will deform and follow the wire. However, the holding wall of the cover of this disclosure holds the wire perpendicular to the wire pull-out surface. Thus, the sealing member will not deform and will not reduce the waterproof function.

The conventional connector with a cover that has no holding wall requires the wire to be pulled out straight for a certain length from the connector housing to suppress deformation of the sealing member. In contrast, the holding walls hold wire perpendicular to the wire pull-out surface in the above configuration. In this way, the sealing member will not deform even if the wire is bent at a position adjacent to the holding walls. In this way, the cover can be smaller.

The holding wall may include a contact edge configured to contact the wire draw-out surface, an end edge extending at an angle to the contact edge and a tapered portion extending obliquely from the end edge to the contact edge on a corner defined by the contact edge and the end edge. The sealing member may deviate slightly from the proper insertion position in the cavity. However, the tapered portion will guide and push the slightly misaligned sealing member into the cavity as the cover is assembled with the connector housing. Thus, the position of the slightly misaligned sealing member is corrected to the proper insertion position. Further, a sealing member that is misaligned a relatively large amount will interfere with the holding walls and will prevent the cover from being assembled with the connector housing. Accordingly, the holding walls correct the position of a slightly misaligned sealing member to the proper insertion position or detect a misalignment that is too large to correct.

The cover may include a first and second covers to be assembled with each other. The first cover may include the guide having the holding walls and locks extending toward the second cover from the holding walls. The second cover may include lock receiving portions to be engaged with the locks. According to this configuration, even if an external force acts on the holding walls, the deflection of the holding walls away from each other is avoided by the engagement of the locks with the lock receiving portions. In this way, the wire reliably is held perpendicular to the wire pull-out surface.

The holding wall may include a retaining portion projecting toward the holding walls and configured to retain the wire. According to this configuration, the retaining portion prevents separation of the wire from between the holding walls so that the wire is held perpendicular to the wire pull-out surface.

One holding wall may include plural retaining portions and the wires may be held between adjacent retaining portions. Accordingly, plural wires can be held between the two holding walls by increasing the number of the retaining portions. Thus, a case where wires drawn out from the connector housing are arranged in rows can be coped with.

The retaining portion may be a leaf spring-like retaining spring. According to this configuration, the amount of deflection of the retaining spring changes according to an outer diameter of the wire held between the pair of holding walls. Thus, a size change of the wire held in the connector housing can be coped with to a certain extent.

According to the connector with cover disclosed by this specification, it is possible to suppress deformation of the sealing member and to ensure a waterproof function.

DETAILED DESCRIPTION

A specific example of the connector disclosed by this specification is described below with reference to the drawings. Note that the invention is not limited to these illustrations and is intended to be represented by claims and include all changes in the scope of claims and in the meaning and scope of equivalents.

Figure 1:
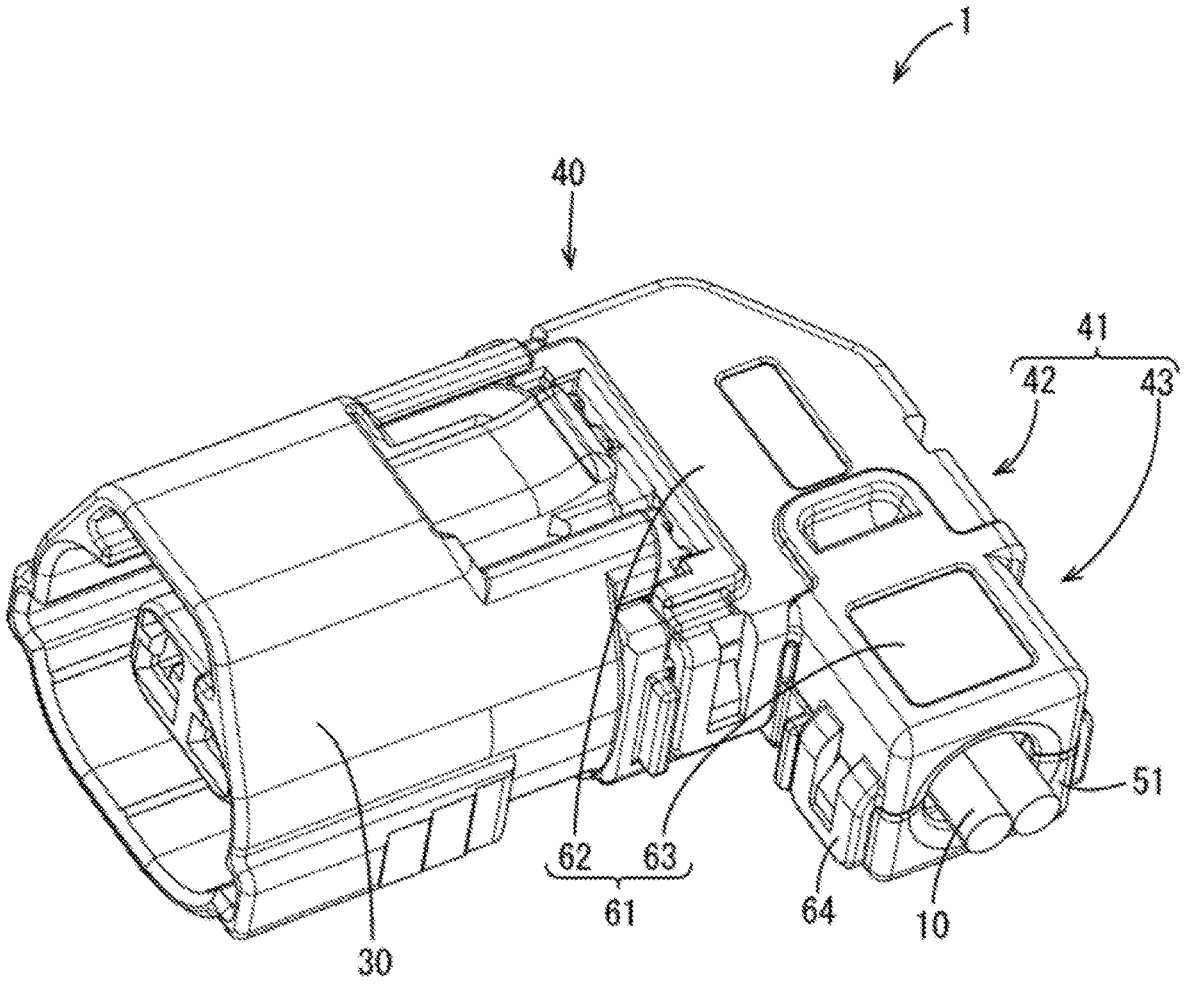
FIG. 1 is a perspective view of a connector with cover of an embodiment.
Figure 2:
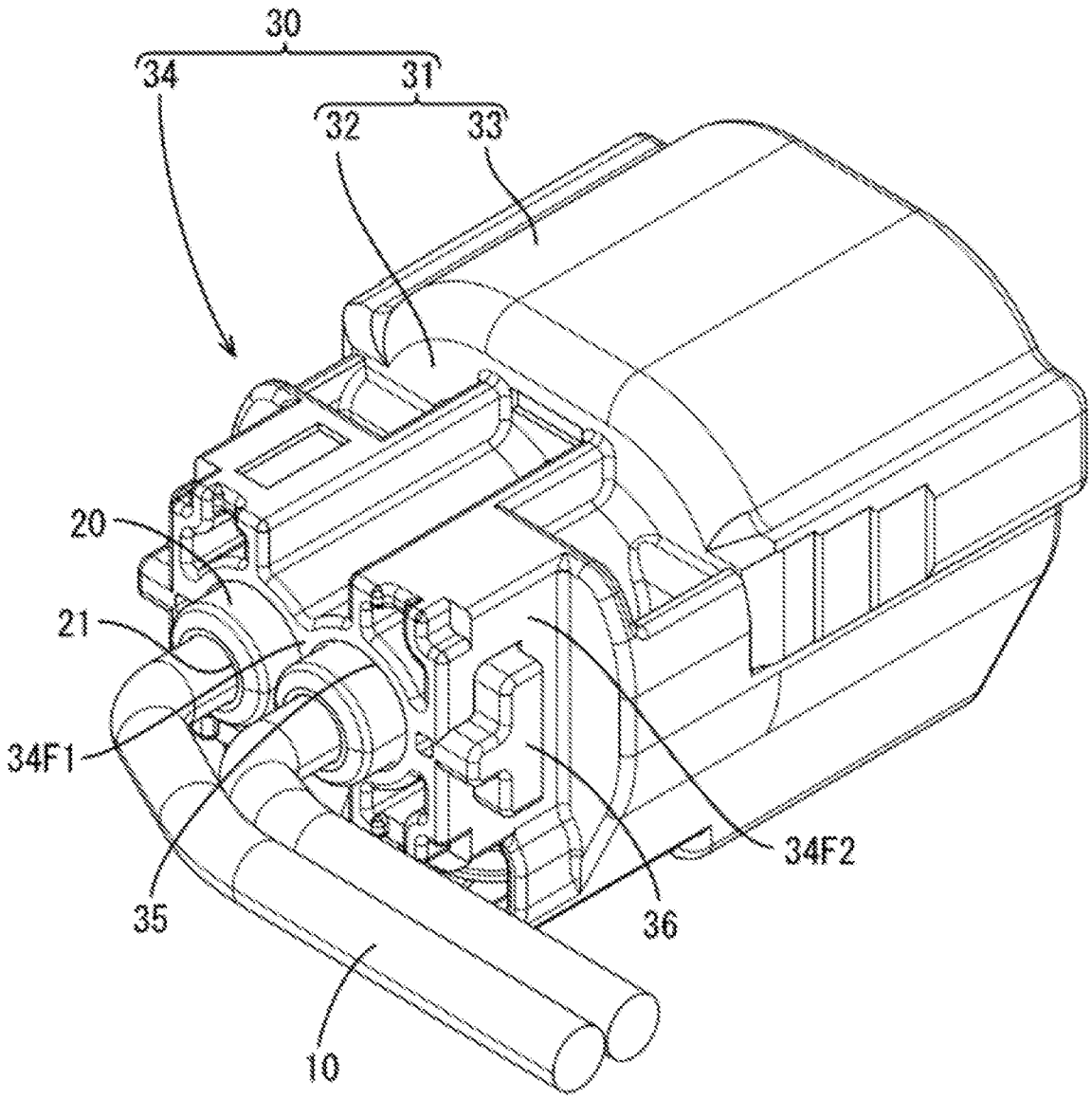
FIG. 2 is a perspective view of a connector housing holding wires and rubber plugs in the embodiment.

An embodiment is described with reference to FIGS. 1 to 6. A connector with cover 1 of this embodiment includes, as shown in FIGS. 1 and 2, wires 10, rubber plugs 20 (equivalent to a sealing member) mounted on the wires 10, a connector housing 30 for holding the wires 10 and a cover 40 to be assembled with the connector housing 30.

[Wires 10 and Rubber Plugs 20]

Figure 5:
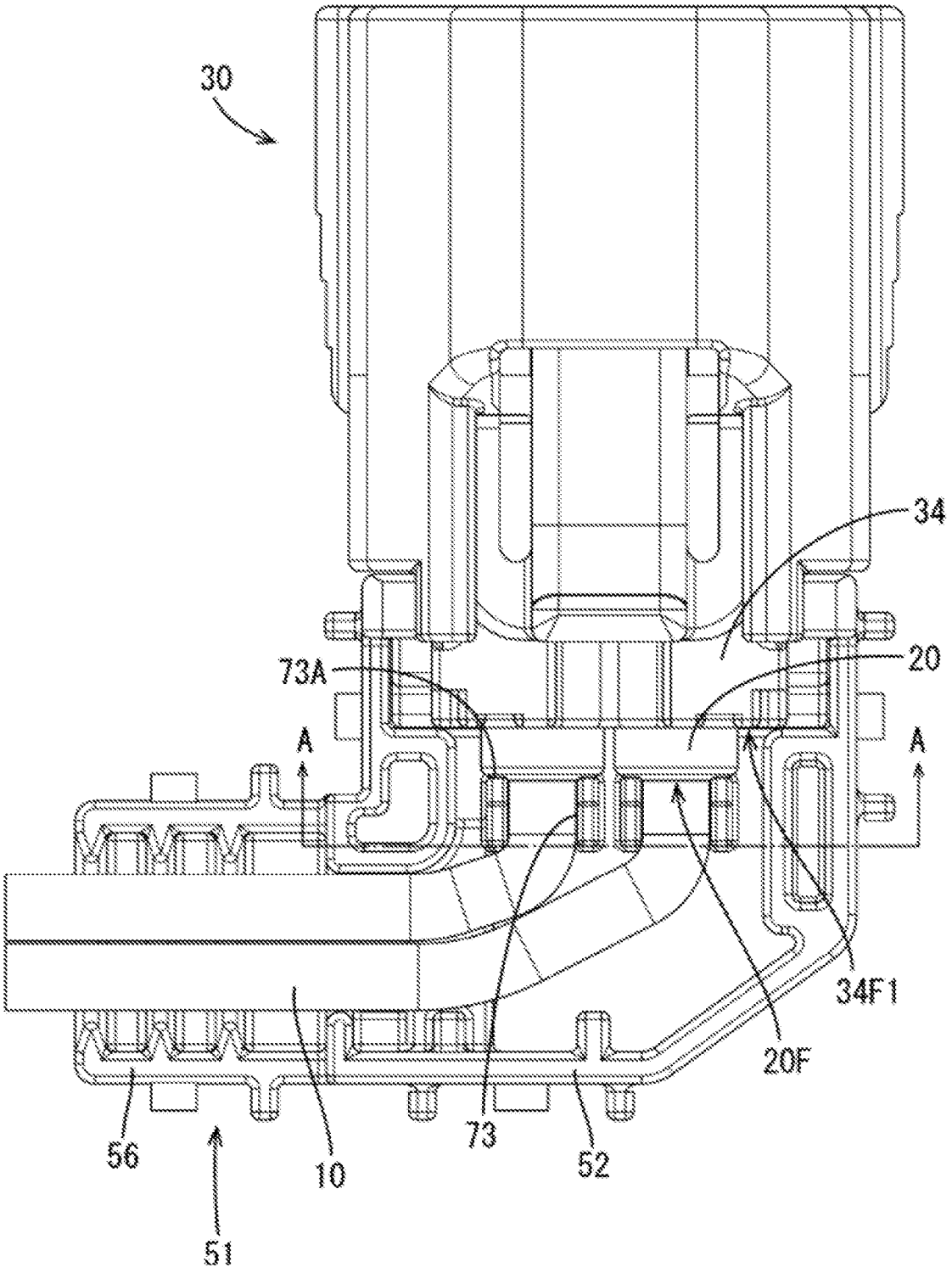
FIG. 5 is a plan view showing the state where the lower cover is assembled with the connector housing holding the wires and the rubber plugs in the embodiment.

Terminal fittings are crimped respectively to the wires 10 and the rubber plug 20 is mounted on an end of each of the wires 10. As shown in FIGS. 2 and 5, the rubber plug 20 has a hollow cylindrical shape with one end defining a wire draw-out surface 20F. A wire insertion hole 21 is open in the wire draw-out surface 20F, and the wire 10 is inserted tightly into the wire insertion hole 21.

[Connector Housing 30]

The connector housing 30 is made of synthetic resin and includes, as shown in FIG. 2, a receptacle 31 to be fit to a mating connector and a wire holding portion 34 continuous from the receptacle 31.

The receptacle 31 includes a back wall 32 in the form of a rectangular plate and a peripheral wall 33 in the form of a rectangular tube extending from the peripheral edge of the back wall 32.

As shown in FIGS. 2 and 5, the wire holding portion 34 is a block-like part extending from the back wall 32 and has a wire pull-out surface 34F1 on a side opposite to the back wall 32. The wire holding portion 34 includes cavities 35 open in the wire pull-out surface 34F1. An end of the wire 10, the terminal fitting and most of the rubber plug 20 are accommodated in each cavity 35 so that the rubber plug 20 seals a clearance between the wire 10 and the inner wall of the cavity 35. An end of the rubber plug 20 on the side of the wire draw-out surface 20F slightly protrudes from the cavity 35 and projects from the wire pull-out surface 34F1. The wire 10 extends from the wire draw-out surface 20F of the rubber plug 20. The wire holding portion 34 has two locking surfaces 34F2 perpendicular to the wire pull-out surface 34F1, and locking protrusions 36 project from these locking surfaces 34F2 for engaging the cover 40.

[Cover 40]

Figure 3:
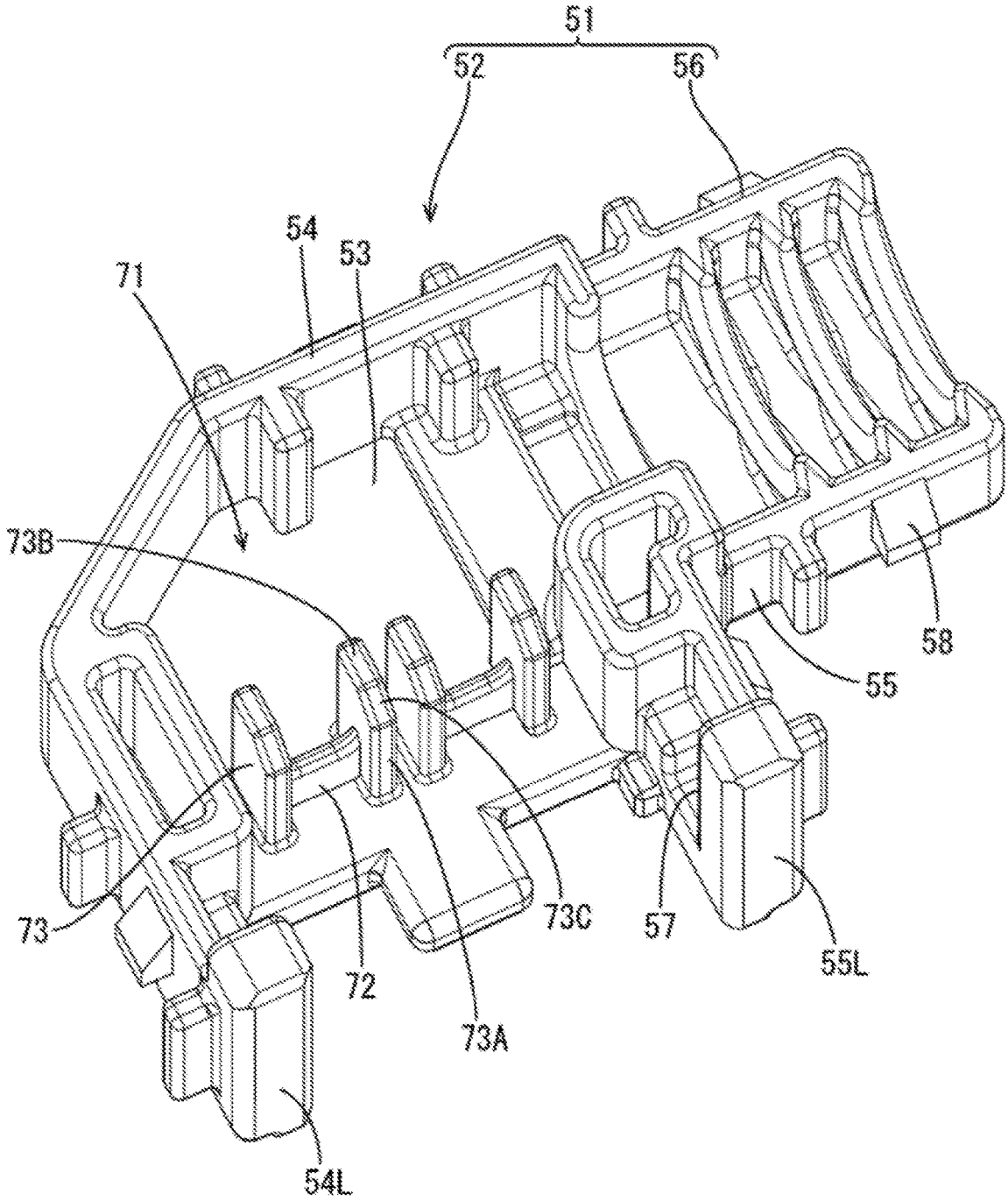
FIG. 3 is a perspective view of a lower cover of the embodiment.

As shown in FIGS. 1 and 3, the cover 40 includes a tubular L-shaped cover body 41 and guides 71 arranged inside the cover body 41. As shown in FIG. 1, the cover body 41 includes a main tube 42 assembled with the wire holding portion 34 to cover one end part including the wire pull-out surface 34F1 and a draw-out portion 43 continuous from this main tube 42.

As shown in FIG. 1, the cover 40 is formed by assembling a lower cover 51 (equivalent to a first cover) and an upper cover 61 (equivalent to a second cover).

As shown in FIG. 3, the lower cover 51 includes a lower main tube portion 52 of the main tube 42, a lower draw-out portion 56 of the draw-out portion 43 and the guides 71 arranged inside the lower main tube portion 52. The lower main tube portion 52 is in the form of an L shaped groove having a U-shaped cross-section. The lower main tube portion 52 includes a bottom wall 53 in the form of an L-shaped flat plate, an L-shaped plate-like outer wall 54 extending from the bottom wall 53 and an L shaped plate-like inner wall 55 likewise extending from the bottom wall 53. The outer and inner walls 54, 55 are perpendicular to the bottom wall 53 and spaced from each other. The lower draw-out portion 56 is connected to one end of the lower main tube portion 52 and is in the form of a groove having a U-shaped cross-section. End parts of the outer and inner walls 54, 55 on a side opposite to the side connected to the lower draw-out portion 56 serve as locking walls 54L, 55L disposed along the locking surfaces 34F2 of the wire holding portion 34. Each of the locking walls 54L, 55L includes a locking recess 57 for receiving the locking protrusion 36.

As shown in FIG. 1, the upper cover 61 includes an upper main tube portion 62 of the main tube 42 and an upper draw-out portion 63 of the draw-out portion 43. The upper main tube portion 62 is an L-shaped flat plat-like part and is parallel to the bottom wall 53. The upper draw-out portion 63 is connected to one end of the upper main tube portion 62 and is in the form of a groove having a U-shaped cross-section.

The lower cover 51 includes locking projections 58, and the upper cover 61 includes locking pieces 64 engage the locking projections 58.

Figure 4:
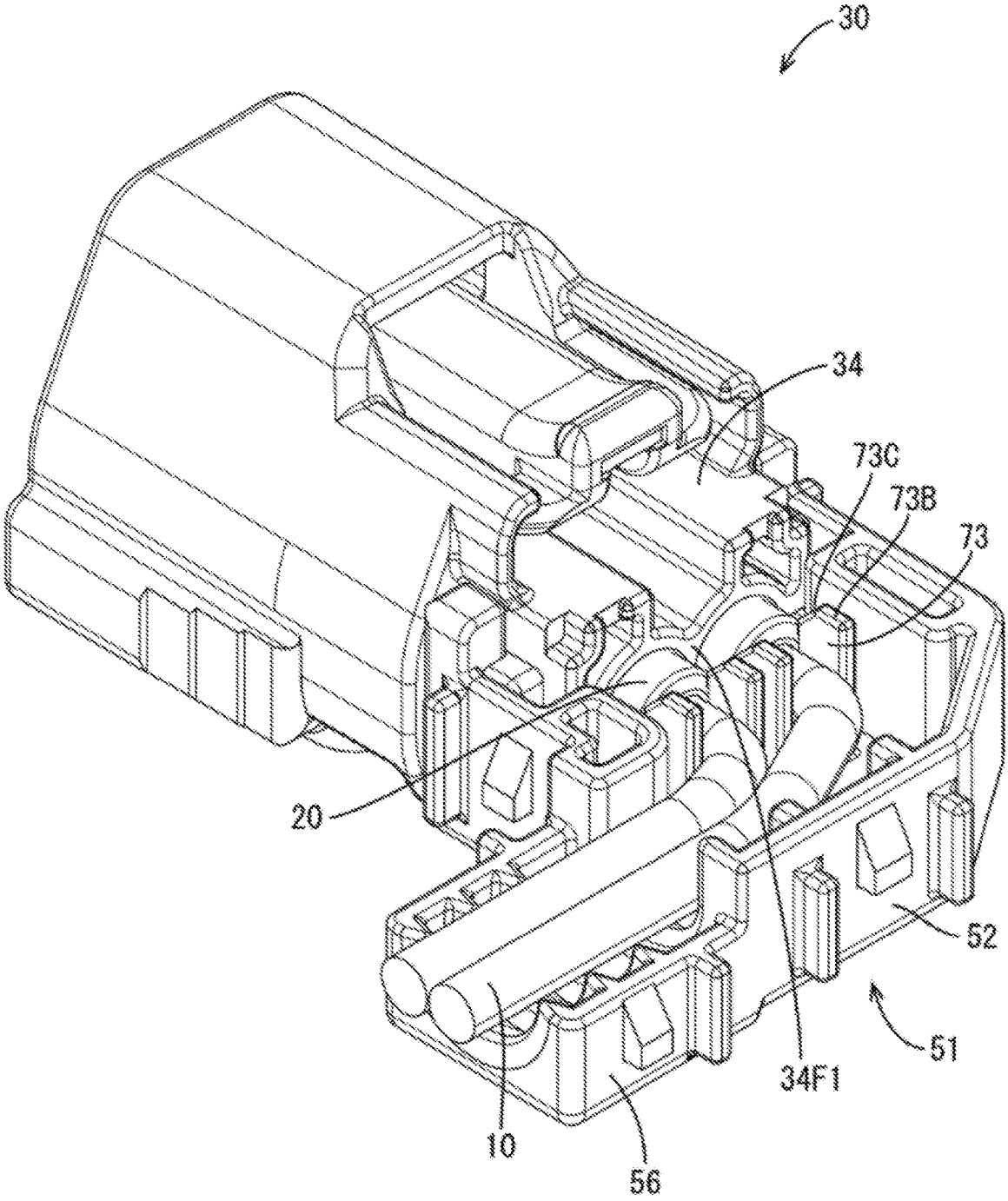
FIG. 4 is a perspective view showing a state where the lower cover is assembled with the connector housing holding the wires and the rubber plugs in the embodiment.

As shown in FIG. 3, each of the guides 71 includes a supporting wall 72 and two holding walls 73. The supporting wall 72 projects from the bottom wall 53 and is parallel to the wire pull-out surface 34F1 when the cover 40 is assembled with the connector housing 30. Each of the holding walls 73 projects from the bottom wall 53 and is longer than the supporting wall 72. The holding walls 73 are perpendicular to the supporting wall 72 and connected to both sides of the supporting wall 72. As shown in FIGS. 4 and 5, the holding walls 73 are perpendicular to the wire pull-out surface 34F1 when the cover 40 is assembled with the connector housing 30.

The holding wall 73 has a contact edge 73A and an extending end edge 73B (equivalent to an end edge). As shown in FIGS. 3 and 5, the contact edge 73A is a surface of the holding wall 73 facing the wire pull-out surface 34F1 when the cover 40 is assembled with the connector housing 30 contacts the wire draw-out surface 20F. As shown in FIG. 3, the extending end edge 73B of the holding wall 73 is on a side opposite to the bottom wall 53 and extends perpendicular to the contact edge 73A. As shown in FIG. 3, the holding wall 73 includes a tapered portion 73C extending obliquely from the extending end edge 73B to the contact edge 73A on a corner part defined by the extending end edge 73B and the contact edge 73A.

Figure 6:
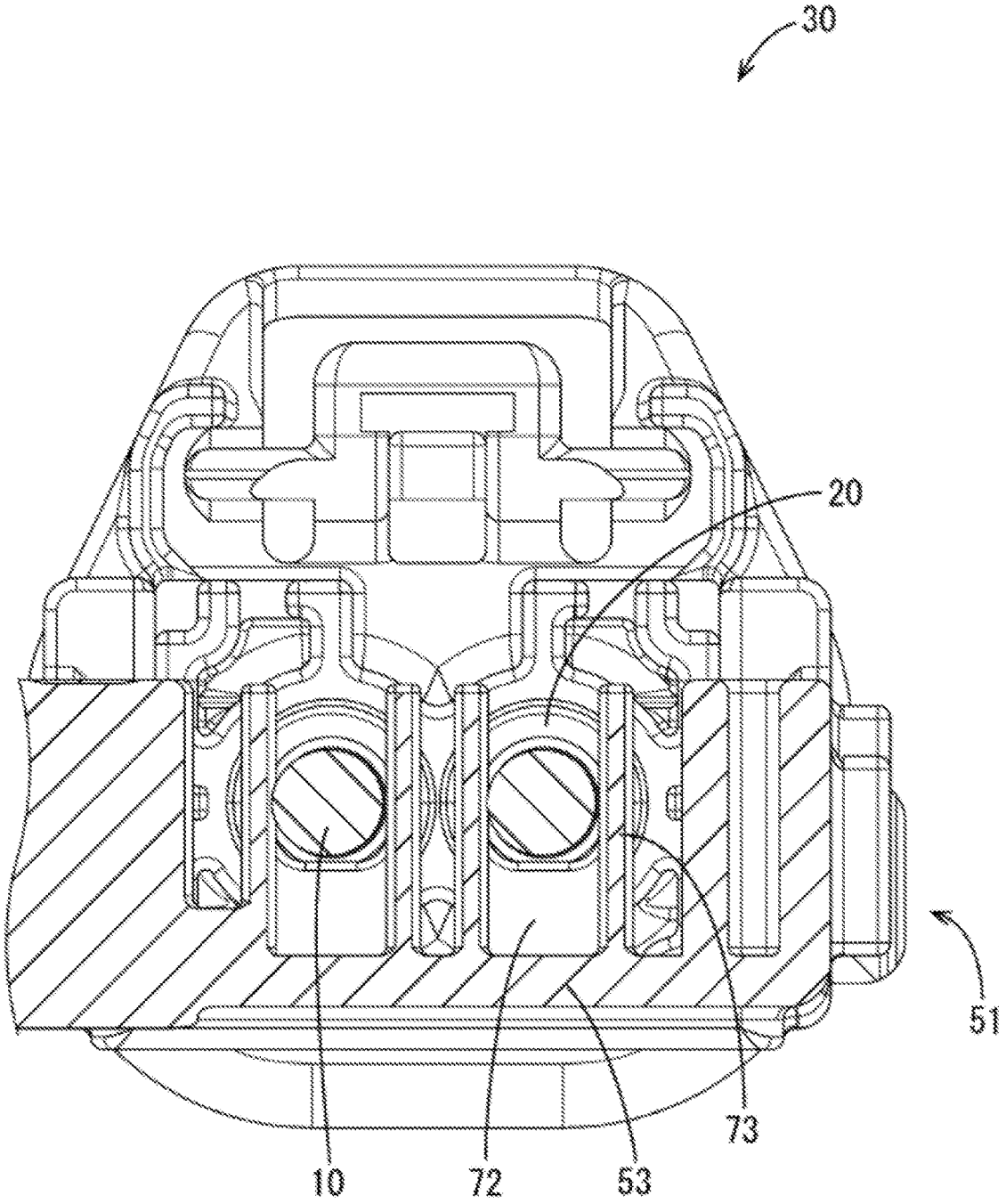
FIG. 6 is a section along A-A of FIG. 5.

Each of the guides 71 comes into contact with the wire draw-out surface 20F of the rubber plug 20 and guides the wire 10 when the cover 40 is assembled with the connector housing 30. As shown in FIGS. 5 and 6, an interval between the holding walls 73 is substantially equal to an outer diameter of the wire 10 and smaller than an outer diameter of the rubber plug 20. One guide 71 holds one wire 10.

[Assembling of Connector with Cover 1]

In assembling the connector with cover, the wires 10 are first mounted into the connector housing 30 as shown in FIG. 2. The wires 10 are inserted into the cavities 35 together with the terminal fittings crimped to the ends and the rubber plugs 20. With the wires 10 held at proper positions, the rubber plugs 20 are held in close contact with the outer peripheral surfaces of the wires 10 and the inner walls of the cavities 35 to seal clearances between the wires 10 and the connector housing 30. In this way, the mounting of the wires 10 into the connector housing 30 is completed.

Subsequently, the cover 40 is assembled with the connector housing 30 having the wires 10 mounted therein.

First, as shown in FIGS. 4 and 5, the lower cover 51 is assembled with the connector housing 30. The lower cover 51 is locked to the connector housing 30 by fitting the locking protrusions 36 into the locking recesses 57. Further, the wires 10 are fit between the two holding walls 73 of the respective guides 71 and held on the supporting wall 72. The wires 10 are routed inside the lower main tube 52 and drawn out from the lower draw-out portion 56 to complete the assembling of the lower cover 51 with the connector housing 30.

Subsequently, as shown in FIG. 1, the upper cover 61 is assembled with the lower cover 51. The lower and upper main tubes 52, 62 and the lower and upper draw-out portions 56, 63 are aligned respectively to face each other and the upper cover 61 is fit to the lower cover 51. By engaging the locking pieces 64 with the respective locking projections 58, the lower cover 51 and the upper cover 61 are locked together. In this way, the lower cover 51 and the upper cover 61 are assembled and the assembling of the connector with cover 1 is completed.

With the assembling of the connector with cover 1 completed, the wires 10 drawn out from the wire holding portion 34 are covered by the cover 40. The wires 10 are bent along the L shape of the main tube 42 and drawn out from the draw-out portion 43.

Further, as shown in FIG. 5, the holding walls 73 are in contact with the wire draw-out surface 20F. In this way, the rubber plug 20 is positioned at a proper insertion position in the cavity 35. Even if the wire 10 is pulled in a direction separating from the cavity 35 by a certain external force applied to the wire 10, the rubber plug 20 is pushed by the holding walls 73 and kept at the proper insertion position so that a waterproof function is maintained.

Further, the rubber plug 20 may deviate from the proper insertion position in the cavity 35 due to an error in the insertion amount of the wire 10 into the cavity 35, an error in the mounted position of the rubber plug 20 on the wire 10 or the like when the wire 10 is mounted into the connector housing 30. However, the holding walls 73 include the tapered portions 73C. If a positional deviation amount of the rubber plug 20 is relatively small, the rubber plug 20 is guided by the tapered portions 73C and pushed into the cavity 35 when the lower cover 51 is assembled with the connector housing 30. In this way, the position of the rubber plug 20 is corrected to the proper insertion position. Further, if the positional deviation amount of the rubber plug 20 is relatively large, the rubber plug 20 interferes with the holding walls 73 and the lower cover 51 cannot be assembled with the connector housing 30. As just described, the holding walls 73 function to correct the position of the rubber plug 20 to the proper insertion position in the cavity 35 or detect an insertion failure.

As shown in FIG. 5, the holding walls 73 are perpendicular to the wire pull-out surface 34F1 and the wire 10 is sandwiched and held by the holding walls 73 with the wire 10 is pulled out perpendicular to the wire pull-out surface 34F1. In a conventional connector having cover including no holding wall, if wires drawn out from a connector housing are bent, the wires extend obliquely to a wire pull-out surface and there is a concern about the deformation of rubber plugs, following the wires. If the rubber plug is deformed, a clearance is formed between the outer peripheral surface of the wire and the inner peripheral surface of a wire insertion hole or between the outer peripheral surface of the rubber plug and the inner wall surface of a cavity and a waterproof function of the rubber plug may be reduced. However, the wire 10 is held perpendicular to the wire pull-out surface 34F1 by the holding walls 73 in this embodiment. In this way, the deformation of the rubber plug 20 is suppressed and a reduction of the waterproof function is avoided.

Further, with the conventional connector with cover including no holding wall, the wires are required to be pulled out straight a certain length from the connector housing to suppress the deformation of the rubber plugs. However, in this embodiment, the holding walls 73 hold the wires 10 perpendicular to the wire pull-out surface 34F1 at positions adjacent to the wire pull-out surface 34F1, as shown in FIG. 5. Thus, the wires 10 bent at positions adjacent to the holding walls 73 will not deform the rubber plugs 20. In this way, a length of the main tube 42 can be made shorter and the cover 40 can be reduced in size.

Functions and Effects

As described above, according to this embodiment, the connector with cover 1 includes the wires 10, the connector housing 30 configured to hold the ends of the wires 10, the rubber plugs 20 configured to seal the clearances between the connector housing 30 and the wires 10 by being mounted on the wires 10 and the cover 40 configured to cover the wires 10 by being assembled with the connector housing 30. The connector housing 30 has the wire pull-out surface 34F1 and includes the cavities 35 open in the wire pull-out surface 34F1 and configured to accommodate the ends of the wires 10 and the rubber plugs 20 inside. The rubber plug 20 has the wire draw-out surface 20F and includes the wire insertion hole 21 open in the wire draw-out surface 20F, the wire 10 being inserted into the wire insertion hole 21. The cover 40 includes the cover body 41 configured to cover the wires 10 and the guides 71 extending from the lower cover 51 constituting the cover body 41 and configured to contact the wire draw-out surfaces 20F and guide the wires 10. Accordingly, the rubber plugs 20 are positioned properly in the cavities 35 by the contact of the guides 71 with the wire draw-out surfaces 20F. Even if the wire 10 is pulled in a direction separating from the cavity 35 by a certain external force applied to the wire 10, the rubber plug 20 is pushed by the guide 71 and held at the proper position. In this way, the waterproof function is ensured.

Further, the guide 71 includes the two holding walls 73 disposed perpendicular to the wire pull-out surface 34F1 and configured to sandwich and hold the wire 10. According to this configuration, the wire 10 is held perpendicular to the wire pull-out surface 34F1 at the position adjacent to the wire pull-out surface 34F1. Here, if the wires 10 drawn out from the connector housing 30 are bent, the wires 10 extend obliquely to the wire pull-out surface 34F1 and there is a concern about a reduction of the waterproof function due to the deformation of the rubber plugs 20, following the wires 10. However, in the configuration of this embodiment, the holding walls 73 hold the wires 10 perpendicular to the wire pull-out surface 34F1. In this way, a reduction of the waterproof function due to the deformation of the rubber plugs 20 is avoided.

Further, with the conventional connector with cover including no holding wall 73, the wires are required to be pulled out straight a certain length from the connector housing to suppress the deformation of the sealing members. However, since the wires 10 are held perpendicular to the wire pull-out surface 34F1 by the holding walls 73 in the configuration of this embodiment, the deformation of the rubber plugs 20 can be avoided even if the wires 10 are bent at positions adjacent to the holding walls 73. In this way, the cover 40 is reduced in size.

Further, the holding wall 73 includes the contact edge 73A configured to contact the wire draw-out surface 20F, the extending end edge 73B extending perpendicular to the contact edge 73A, and the tapered portion 73C extending obliquely from the extending end edge 73B to the contact edge 73A on the corner part defined by the contact edge 73A and the extending end edge 73B. Accordingly, if the positional deviation amount of the rubber plug 20 from the proper insertion position in the cavity 35 is relatively small, the rubber plug 20 is guided by the tapered portions 73C and pushed into the cavity 35 when the cover 40 is assembled with the connector housing 30. In this way, the position of the rubber plug 20 is corrected to the proper insertion position. Further, if the positional deviation amount of the rubber plug 20 from the proper insertion position in the cavity 35 is relatively large, the rubber plug 20 interferes with the holding walls 73 and the cover 40 cannot be assembled with the connector housing 30. As just described, the guide 71 functions to correct the position of the rubber plug 20 to the proper insertion position in the cavity 35 or detect an insertion failure.

First Modification

Next, a first modification is described with reference to FIGS. 7 to 10. A connector with cover 100 of this modification differs from the above embodiment in that guides 112 provided in a lower cover 111 include locks 114 extending from holding walls 113 and an upper cover 115 includes locking holes 117 (equivalent to lock receiving portions) for receiving the locks 114. In this modification, the same components as those of the above embodiment are denoted by the same reference signs and not described.

Figure 8:
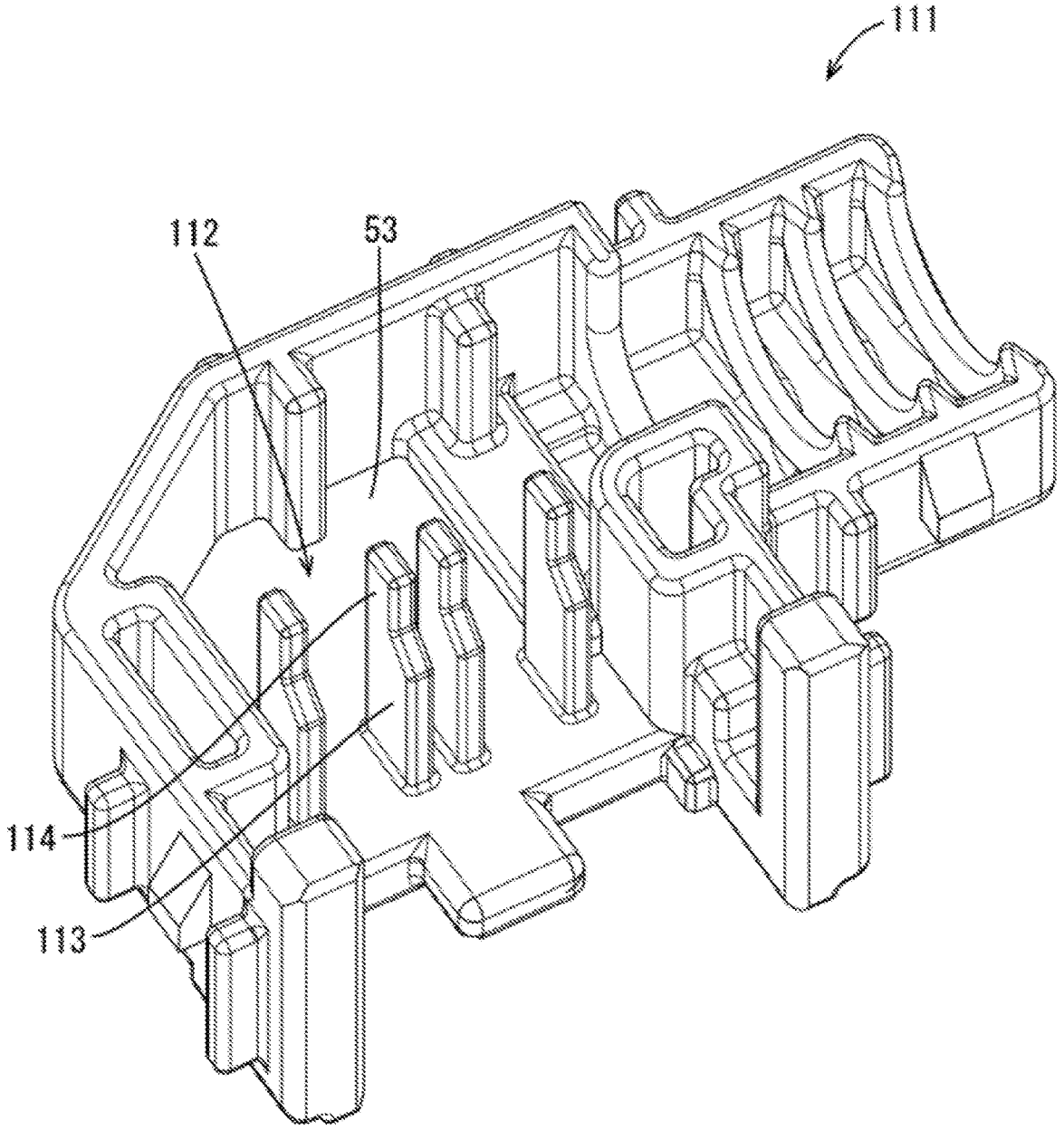
FIG. 8 is a perspective view of a lower cover of the first modification.
Figure 9:
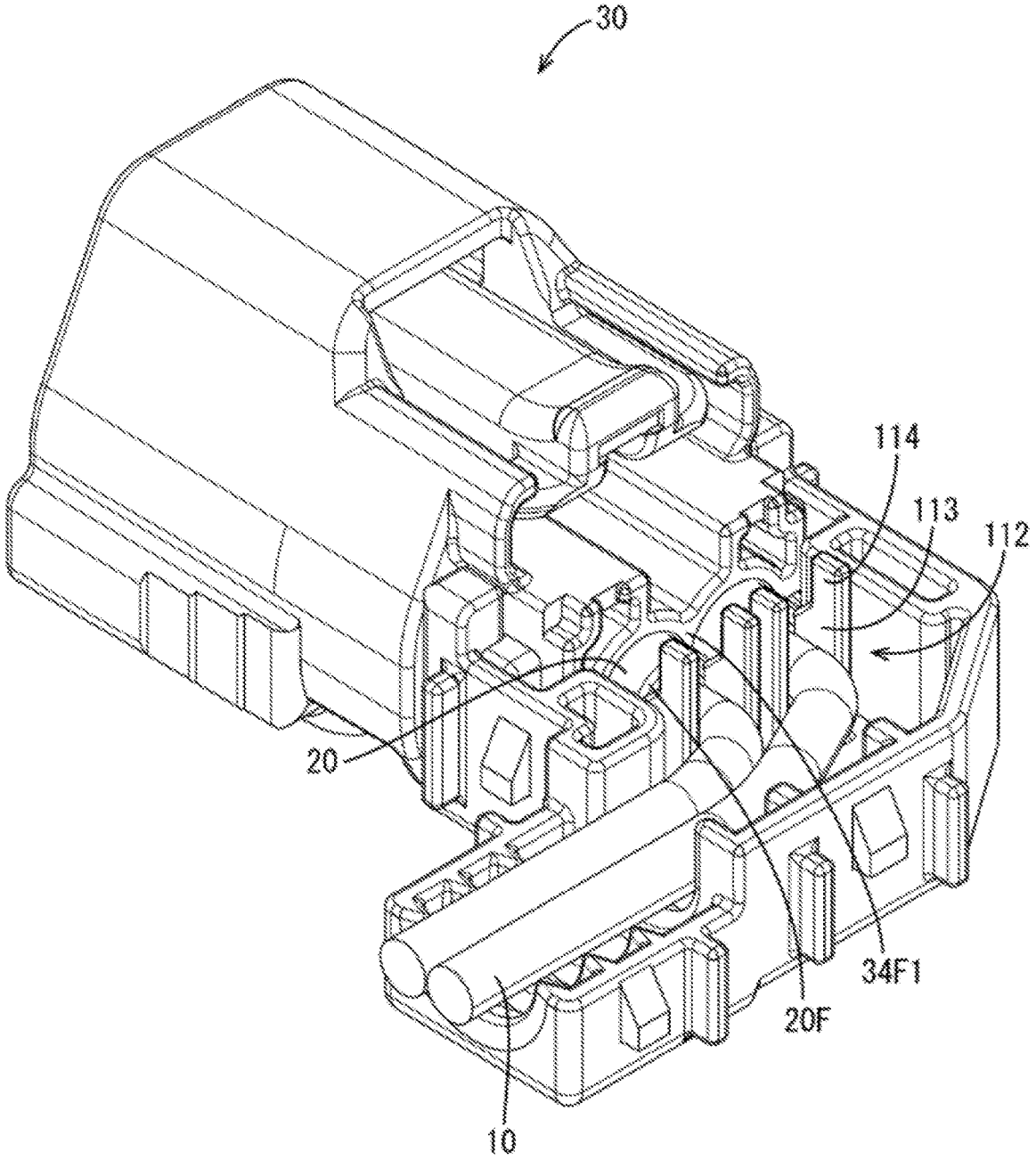
FIG. 9 is a perspective view showing a state where the lower cover is assembled with a connector housing holding wires and rubber plugs in the first modification.
Figure 10:
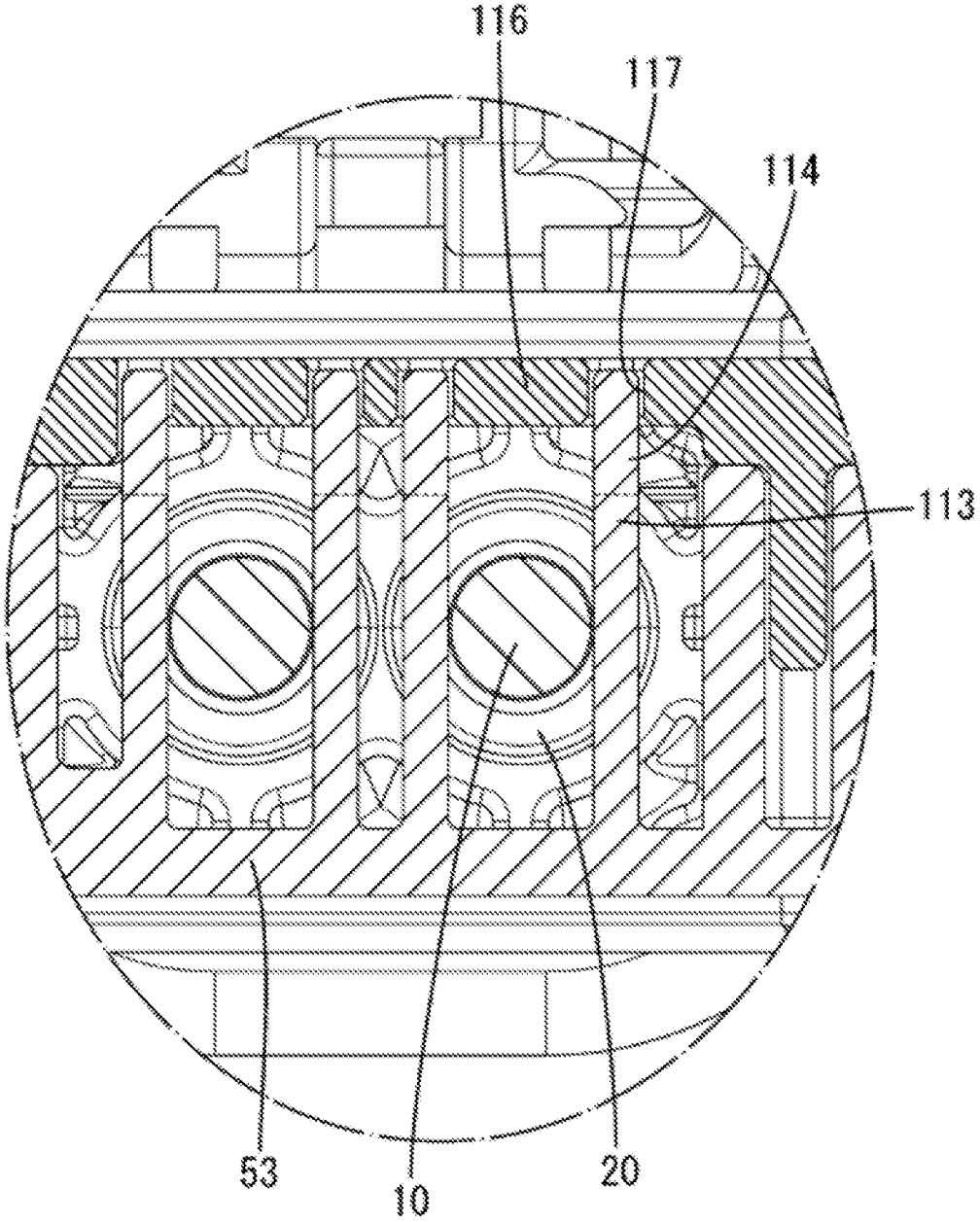
FIG. 10 is a section along B-B of FIG. 7.

A cover 110 includes the lower cover 111 and the upper cover 115 to be assembled with the lower cover 111 as in the above embodiment. The lower cover 111 includes the guides 112 extending from a bottom wall 53. As shown in FIG. 8, the guide 112 includes the holding walls 113 and the locks 114 respectively extending from the holding walls 113. Each of the holding walls 113 project from the bottom wall 53. As shown in FIG. 9, the holding walls 113 are arranged in a posture perpendicular to a wire pull-out surface 34F1 with the lower cover 111 assembled with a connector housing 30. As shown in FIGS. 8, 9 and 10, the locking projecting piece 114 is a plate piece-like part extending from an extending end of the holding wall 113 toward an upper main tube portion 116.

Figure 7:
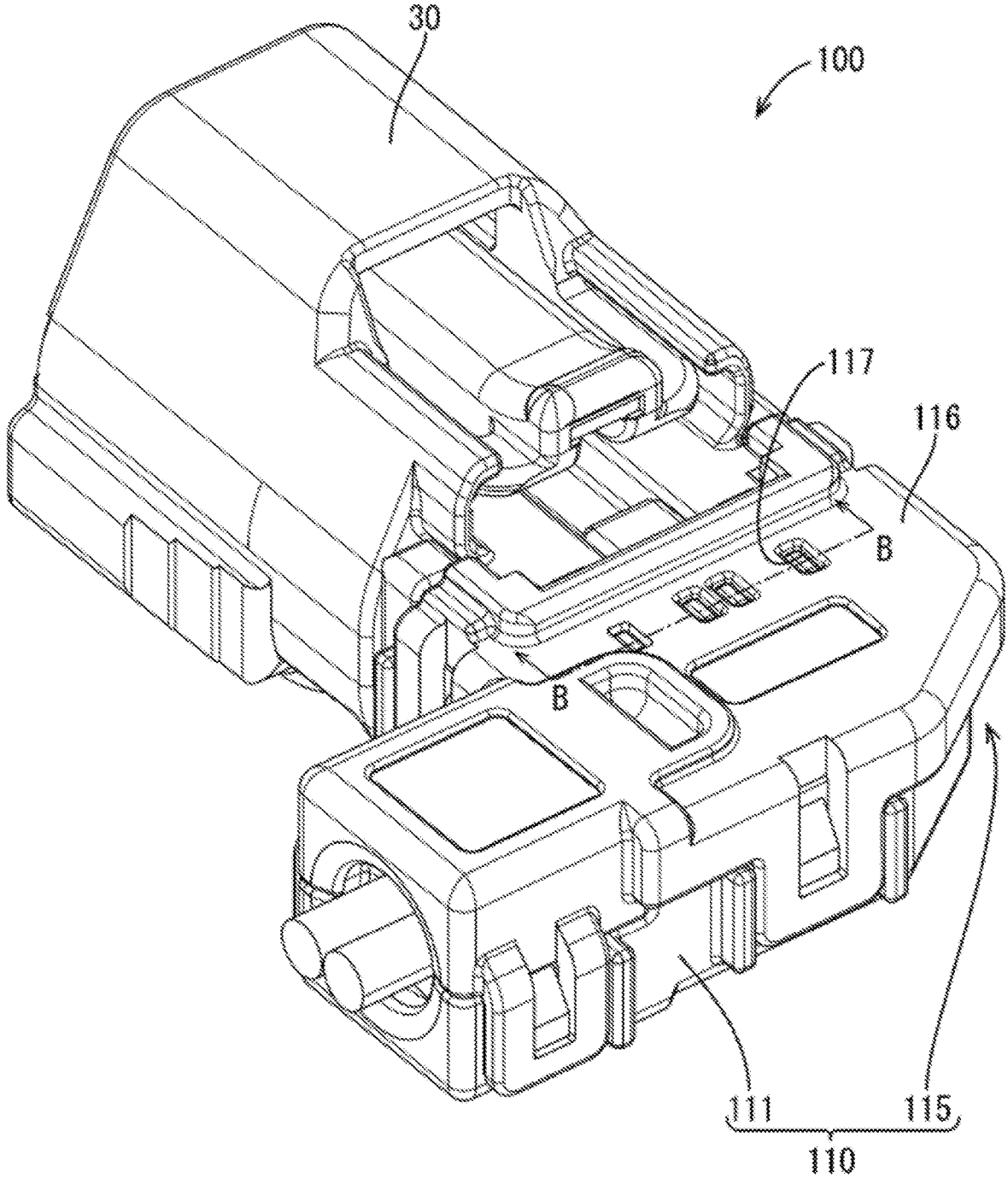
FIG. 7 is a perspective view of a connector with cover of a first modification.

The upper main tube portion 116 of the upper cover 115 includes the locking holes 117 for receiving the locks 114 as shown in FIGS. 7 and 10. The locking holes 117 are through holes penetrating through the upper main tube portion 116.

This modification has functions and effects similar to those of the above embodiment are achieved. Further, with the lower cover 111 and the upper cover 115 assembled with each other, the tips of the locks 114 are inserted in the locking holes 117 as shown in FIG. 10. According to this configuration, even if a certain external force acts on the holding walls 113, the deflection of the holding walls 113 in directions separating from each other is avoided by the locks 114 locking the hole edges of the locking holes 117. In this way, the wires 10 reliably is held perpendicular to the wire pull-out surface 34F1.

Second Modification

A second modification is described with reference to FIGS. 11 to 13. In this modification, the same components as those of the above embodiment are denoted by the same reference signs and not described.

Figure 11:
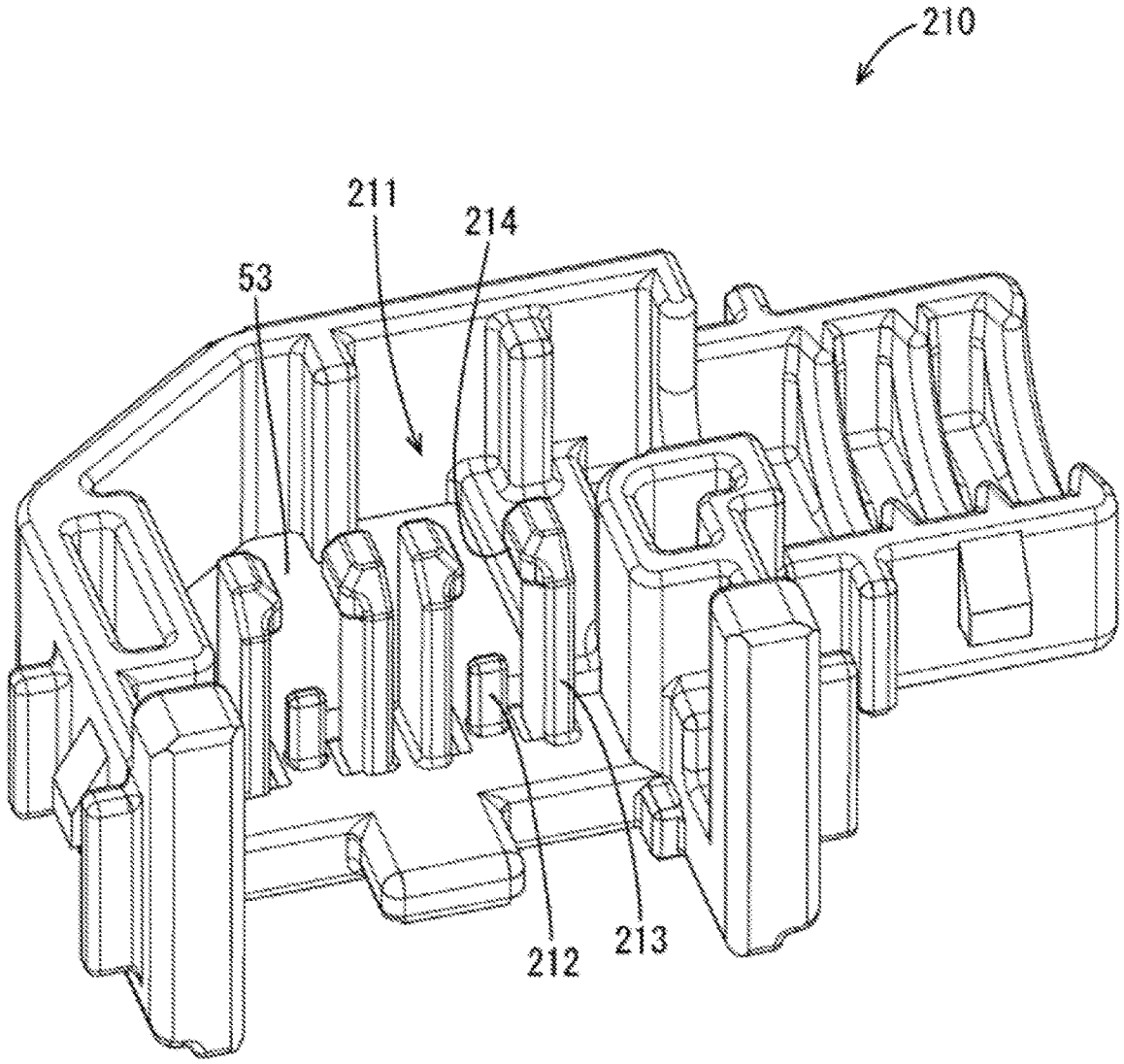
FIG. 11 is a perspective view of a lower cover of a second modification.

A guide 211 provided in a lower cover 210 includes a supporting column 212, two holding walls 213 and retaining claws 214 (equivalent to a retaining portion) respectively extending from the tips of the holding walls 213, as shown in FIG. 11. The supporting column 212 projects from a bottom wall 53. Each of the pair of holding walls 213 is a wall portion likewise projecting from the bottom wall 53 and is longer than the supporting column 212. As shown in FIG. 12, the holding walls 213 are arranged across the supporting column 212 in a posture perpendicular to a wire pull-out surface 34F1 with the lower cover 210 assembled with a connector housing 30. The retaining claw 214 is a claw-like part projecting toward the paired mating holding wall 213 from an extending end of the holding wall 213.

Figure 12:
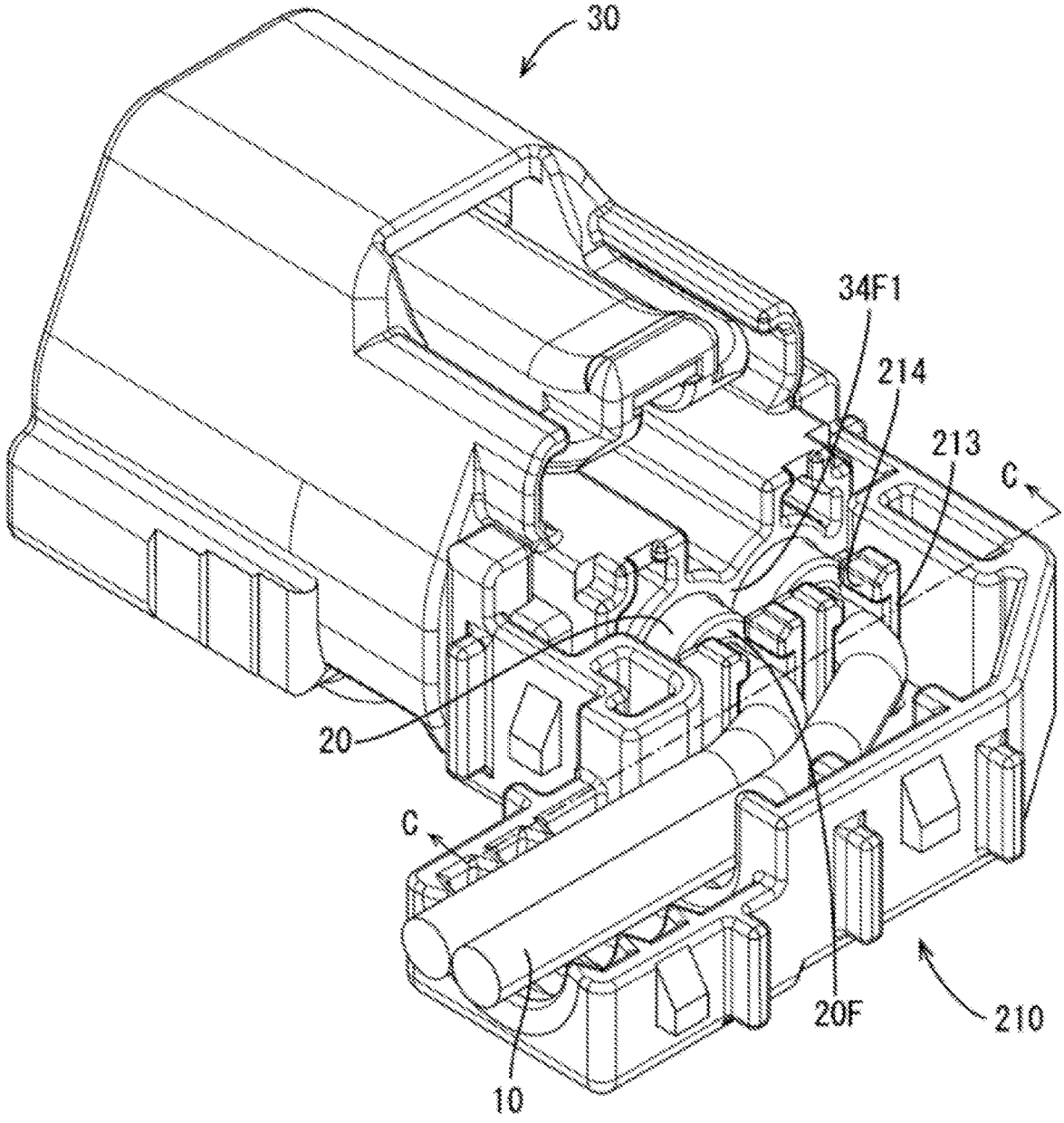
FIG. 12 is a perspective view showing a state where the lower cover is assembled with a connector housing holding wires and rubber plugs in the second modification.
Figure 13:
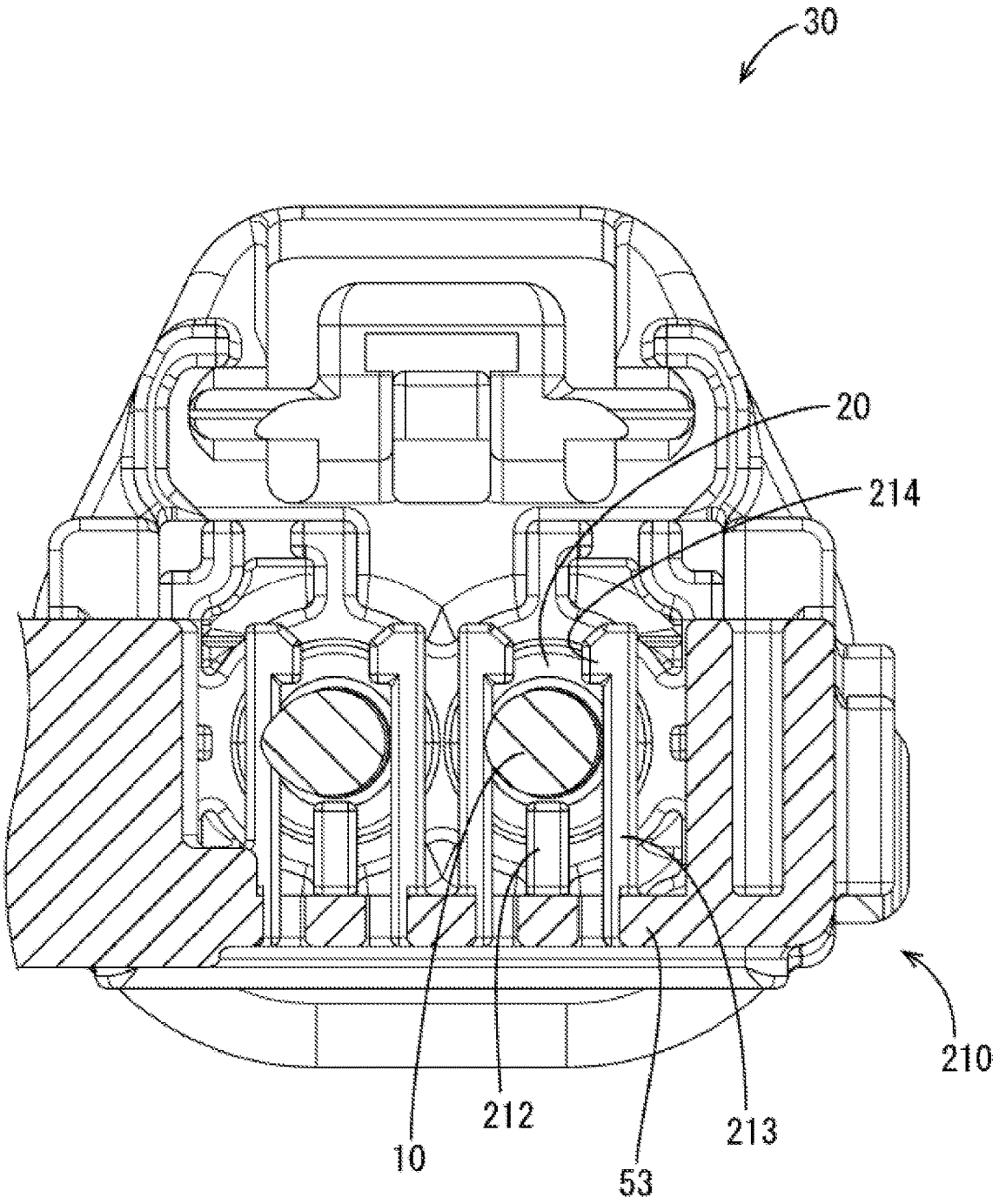
FIG. 13 is a section along C-C of FIG. 12.

When the lower cover 210 is assembled with the connector housing 30, the wires 10 are fit respectively into the guides 211 as shown in FIGS. 12 and 13. Specifically, the wire 10 is inserted between the two holding walls 213 and held on the supporting column 212.

This modification has functions and effects similar to those of the above embodiment. Further, the guide 212 includes the retaining claws 214 that interfere with the wire 10 if the wire 10 is urged in a direction (upper direction of FIG. 13) away from the holding walls 213. In this way, the wire 10 cannot separate from between the holding walls 213 in an unintended situation, and the wires 10 can be reliably held perpendicular to the wire pull-out surface 34F1.

Third Modification

Figure 14:
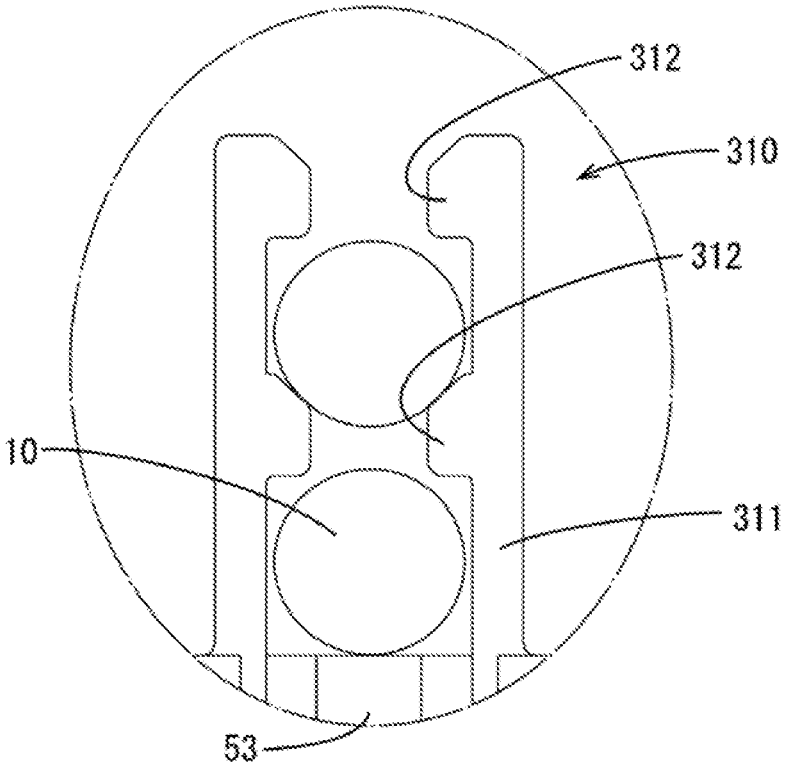
FIG. 14 is a partial enlarged view of a guide portion of a third modification.

A third modification is described with reference to FIG. 14. In this modification, the same components as those of the above embodiment are denoted by the same reference signs and not described.

A guide 310 includes two holding walls 311 and retaining claws 31 (equivalent to retaining portions) extending from each of the holding walls 311. Each of the holding walls 311 projects from a bottom wall 53. As in the above embodiment, the holding walls 311 are perpendicular to a wire pull-out surface 34F1. The retaining claw 314 projects toward the paired mating holding wall 311 from an extending end of the holding wall 311. One holding wall 311 includes two retaining claws 312. One of the two retaining claws 312 is arranged at an intermediate position between the extending end of the holding wall 311 and the bottom wall 53, and the other is arranged on the extending end of the holding wall 312. An interval between the bottom wall 53 and the one retaining claw 312 and an interval between the one retaining claw 312 and the other retaining claw 312 are substantially equal to an outer diameter of a wire 10.

Two wires 10 extending from a connector housing 30 are held by one guide portion 310. One wire 10 is held between the bottom wall 53 and the one retaining claws 312 and another wire 10 is held between the one retaining claws 312 and the other retaining claws 312.

This modification has functions and effects similar to those of the above embodiment. Further, one holding wall 311 includes two retaining claws 312. One wire 10 is held between the bottom wall 53 and the one retaining claws 312, and the other wire 10 is held between the one retaining claws 312 and the other retaining claws 312. Accordingly, a case where there are two rows of the wires 10 drawn out from the connector housing 30 and arranged along the bottom wall 53 can also be coped with.

Fourth Modification

Figure 15:
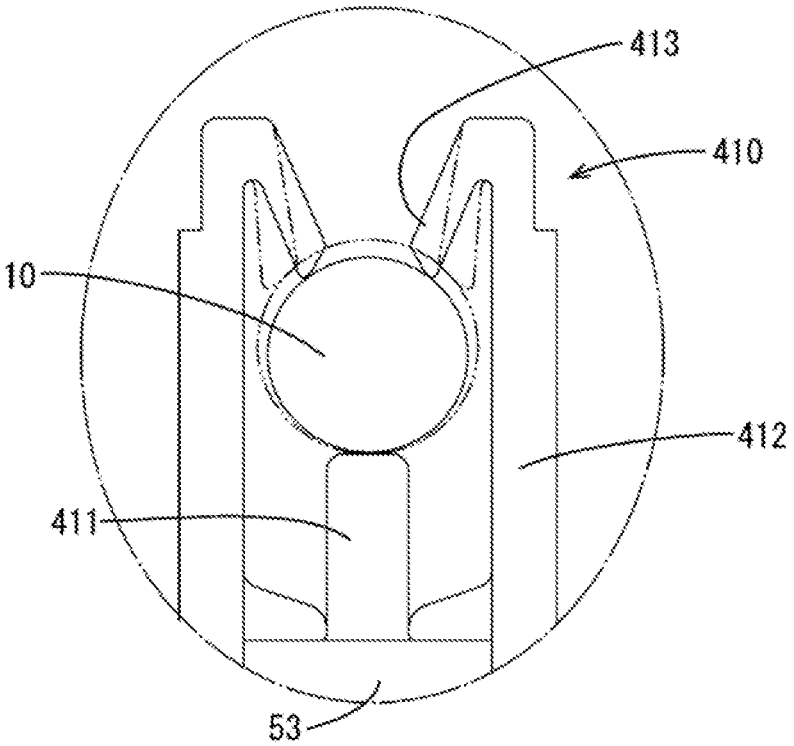
FIG. 15 is a partial enlarged view of a guide portion of a fourth modification.

A fourth modification is described with reference to FIG. 15. In this modification, the same components as those of the above embodiment are denoted by the same reference signs and not described.

A guide 410 includes a supporting column 411, two holding walls 412 and retaining springs 413 (equivalent to a retaining portion) respectively extending from the tips of the pair of holding walls 412. The supporting column 411 projects from a bottom wall 53. Each of the holding walls 412 projects from the bottom wall 53 farther than the supporting column 411. As in the above embodiment, the holding walls 412 are arranged across the supporting column 411 in a posture perpendicular to a wire pull-out surface 34F1. The retaining spring 413 is a leaf spring-like part projecting toward the bottom wall 53 from an extending end of the holding wall 412. The retaining spring 413 is inclined with respect to the holding wall 412 to approach the mating holding wall 412 with distance from the extending end of the holding wall 412, and deflectable in a direction toward and away from the holding wall 412. An interval between the holding walls 412 is somewhat larger than an outer diameter of a wire 10 and smaller than an outer diameter of a rubber plug 20.

This modification has functions and effects similar to those of the above embodiment. Further, the retaining springs 413 prevent separation of the wire 10 from between the holding walls 412. In this way, the wires 10 reliably are held perpendicular to the wire pull-out surface 34F1. Further, the amount of deflection of the retaining springs 413 changes according to the outer diameter of the wire 10 held between the holding walls 412 so that a size change of the wires held in the connector housing can be coped with to a certain extent.

OTHER EMBODIMENTS

Although each of the guides 71 has the two holding walls 73 in the above embodiment, one holding wall arranged between adjacent wires may be shared by two adjacent guides.

Although one retaining claw 214 extends from one holding wall 213 in the second modification and two retaining claws 312 extend from one holding wall 311 in the third modification, a case where wires are arranged in three or more rows can be coped with by increasing the number of retaining portions projecting from one holding wall.

The retaining portion may be provided on only one of the holding walls.

LIST OF REFERENCE SIGNS

1, 100: connector with cover
10: wire
20: rubber plug (sealing member)
20F: wire draw-out surface
21: wire insertion hole
30: connector housing
31: receptacle
32: back wall
33: peripheral wall
34: wire holding portion
34F1: wire pull-out surface
34F2: locking surface
35: cavity
36: locking protrusion
40, 110: cover
41: cover body
42: main tube portion
43: draw-out portion
51, 111, 210: lower cover (first cover)
52: lower main tube portion
53: bottom wall
54: outer wall
54L, 55L: locking wall
55: inner wall
56: lower draw-out portion
57: locking recess
58: locking projection
61, 115: upper cover (second cover)
62, 116: upper main tube portion
63: upper draw-out portion
64: locking piece
71, 112, 211, 310, 410: guide
72: supporting wall
73, 113, 213, 311, 412: holding wall
73A: contact edge
73B: extending end edge (end edge)
73C: tapered portion
114: locking projecting piece (locking portion)
117: locking hole (lock receiving portion)
212, 411: supporting column
214, 312: retaining claw (retaining portion)
413: retaining spring (retaining portion)

What is claimed is:

1. A connector with cover, comprising:

a connector housing;

a wire having an end portion held in the connector housing and a bent part external of the connector housing;

a sealing member mounted on the wire and configured to seal a clearance between the connector housing and the wire; and a cover assembled with the connector housing and configured to cover the sealing member and the bent part of the wire external of the connector housing, wherein:

the connector housing has a wire pull-out surface, a cavity open in the wire pull-out surface and configured to accommodate the end portion of the wire and a part of the sealing member inside, the sealing member has a wire draw-out surface facing away from the housing and includes a wire insertion hole open in the wire draw-out surface, the wire being inserted into the wire insertion hole, and the cover includes a cover body configured to cover the bent part of the wire and a guide extending from the cover body and configured to contact the wire draw-out surface and guide the wire between the wire draw-out surface and the bent part of the wire.

2. The connector with cover of claim 1, wherein the guide includes a pair of holding walls disposed perpendicular to the wire pull-out surface and configured to sandwich and hold the wire between the wire pull-out surface and the bent part of the wire.

3. The connector with cover of claim 2, wherein the wire is a first wire, and the connector further includes a second wire having a bent part, and the pair of holding walls is a first pair of holding walls configured to sandwich and hold the first wire between the wire pull-out surface and the bent part of the first wire, the guide further including a second pair of holding walls disposed perpendicular to the wire pull-out surface and configured to sandwich and hold the second wire between the wire pull-out surface and the bent part of the second wire.

4. A connector with cover, comprising:

a wire;

a connector housing configured to hold an end portion of the wire;

a sealing member mounted on the wire and configured to seal a clearance between the connector housing and the wire; and a cover assembled with the connector housing and configured to cover the wire, wherein:

the connector housing has a wire pull-out surface and includes a cavity open in the wire pull-out surface and configured to accommodate the end portion of the wire and the sealing member inside, the sealing member has a wire draw-out surface and includes a wire insertion hole open in the wire draw-out surface, the wire being inserted into the wire insertion hole, the cover includes a cover body configured to cover the wire and a guide extending from the cover body and configured to contact the wire draw-out surface and guide the wire, the guide includes two holding walls disposed perpendicular to the wire pull-out surface and configured to sandwich and hold the wire, and each of the holding walls includes a contact edge configured to contact the wire draw-out surface, an end edge extending at an angle to the contact edge and a tapered portion extending obliquely from the end edge to the contact edge on a corner part defined by the contact edge and the end edge.

5. The connector with cover of claim 4, wherein:

the cover includes a first cover and a second cover to be assembled with each other, the first cover includes the guide having the holding walls and locks extending toward the second cover from the holding walls, and the second cover includes lock receiving portions to be engaged with the locks.

6. The connector with cover of claim 4, wherein the holding wall includes a retaining portion projecting toward a mating one of the holding walls and configured to retain the wire.

7. The connector with cover of claim 6, wherein one of the holding walls includes a plurality of the retaining portions adjacent to one another and the wire is held between the adjacent retaining portions.

8. The A connector with cover, comprising:

a wire;

a connector housing configured to hold an end portion of the wire;

a sealing member mounted on the wire and configured to seal a clearance between the connector housing and the wire; and a cover assembled with the connector housing and configured to cover the wire, wherein:

the connector housing has a wire pull-out surface and includes a cavity open in the wire pull-out surface and configured to accommodate the end portion of the wire and the sealing member inside, the sealing member has a wire draw-out surface and includes a wire insertion hole open in the wire draw-out surface, the wire being inserted into the wire insertion hole, the cover includes a cover body configured to cover the wire and a guide extending from the cover body and configured to contact the wire draw-out surface and guide the wire, the guide includes two holding walls disposed perpendicular to the wire pull-out surface and configured to sandwich and hold the wire, the holding wall includes a retaining portion projecting toward a mating one of the holding walls and configured to retain the wire, and the retaining portion is a leaf spring-like retaining spring.

* * * * *